United States Patent [19]

Chiang et al.

[11] 4,045,638

[45] Aug. 30, 1977

[54] CONTINUOUS FLOW HEAT TREATING APPARATUS USING MICROWAVES

[76] Inventors: Bing Chiang, 3413 Dunnington Road, Beltsville, Md. 20705; Alfred F. Hoyte, 7734 16th St. NW., Washington, D.C. 20012

[21] Appl. No.: 665,195

[22] Filed: Mar. 9, 1976

[51] Int. Cl.[2] ..... H05B 9/06

[52] U.S. Cl. ..... 219/10.55 A; 34/1; 34/164; 219/10.55 B; 219 10.55 D/; 219/10.55 M

[58] Field of Search ..... 219/10.55 A, 10.55 B, 219/10.55 M, 10.55 R, 10.55 D; 34/1, 4, 17, 164

[56] References Cited

U.S. PATENT DOCUMENTS

| | | | |
|---|---|---|---|
| 3,528,179 | 9/1970 | Smith | 34/1 |
| 3,545,093 | 12/1970 | Forster | 219/10.55 A |
| 3,707,355 | 12/1972 | Anderson | 34/164 |
| 3,909,574 | 9/1975 | Muller et al. | 219/10.55 A |
| 3,953,703 | 4/1976 | Hurwitt | 219/10.55 A |

*Primary Examiner*—Arthur T. Grimly
*Attorney, Agent, or Firm*—Dowell and Dowell

[57] ABSTRACT

Apparatus for heat treating particulate materials in bulk form including a vibrating conveyor fed continuously with materials at one end and discharging them at the other end, the conveyor moving the materials through the apparatus with a tossing motion insuring continuous turnings and mixing thereof, the conveyor having a longitudinal trough through which the materials travel past three heating zones, the first two zones being heated by electrical resistance heaters and the third zone being microwave heated to a very high temperature, the apparatus having a cover over the zones sealed to prevent loss of heat and microwave energy, the cover and conveyor trough being lined with refractory insulation which increases in thickness through the successive zones, and the insulation having microwave reflective means embedded therein in the third zone to concentrate the microwave energy in the vicinity of the trough.

12 Claims, 5 Drawing Figures

CONTINUOUS FLOW HEAT TREATING APPARATUS USING MICROWAVES

FIELD OF INVENTION

This invention relates to apparatus for processing granular or particulate bulk materials by heating them while they move continuously through the apparatus, and relates more particularly to electrical heat treating apparatus using resistance element heating followed by microwave heating in a final stage to achieve very high temperatures.

BACKGROUND AND PRIOR ART

Conventionally, it has been the practice to heat treat particulate bulk materials, for instance, in the manufacture of cement or in a process for calcining bauxite, by using oil as the fuel. In processes requiring high temperatures, above 2000° F, it has been impractical to use conventional resistance heating elements because the life of such elements becomes very limited when they are heated beyond about 2000° F.

The treating of alumina hydrate to recover aluminum from it involves the pre-heating of the hydrate to drive off water vapor and produce gamma phase alumina. The latter is not a stable product because it will absorb moisture again and return to the hydrate state. However, further heating of the gamma phase to 3000° F will convert the gamma phase alumina to alpha phase alumina which will not re-hydrate. Moreover, this heat treating reduces the bulk to about one-third of the bulk of the alumina hydrate and, therefore, to a good state for shipping to a refining plant. The present heat treating apparatus is designed to effect this conversion using microwave techniques.

A number of patents exist teaching the use of microwave heating in industrial processes and apparatus for treating lossy materials such as food, rubber, lumber, etc., and some patents show the use of microwave units for heating granular bulk materials, particularly where the flow of the materials need not be continuous, or if continuous, where the temperatures to be achieved are not very high as shown, for example, in U.S. Pat. No. 2,467,230 to Revercomb and U.S. Pat. No. 2,500,752 to Hanson. U.S. Pat. No. 3,422,242 to Miyata shows a semicontinuous unit in which the materials are introduced in steps separated by the opening and closing of oven doors, the patent also showing the use of water filled chokes to seal the doors when closed.

U.S. Pat. No. 3,469,053 to Levinson shows the use of thermal insulation inside a microwave oven to help retain the heat against leakage from the oven, and the same is true of U.S. Pat. No. 3,701,872 to Levinson, but these patents do not show the continuous flow of particulate bulk materials which are at the same time treated at very high temperatures, i.e., at about 3000° F as in the present invention. U.S. Pat. No. 3,678,238 to Yasouka shows a microwave choke sealing an oven door.

THE INVENTION

This invention discloses an apparatus for heat treating particulate materials passing in bulk continuously through the apparatus on a vibrating conveyor taking the form of an elongated metal pan lined with refractory insulation. The pan is covered by a metal cover which is stationary and insulation lined, and special choke seals are provided around the periphery of these components to prevent the escape of microwave energy from the apparatus as the pan undulates and translates with respect to the motionless cover. There are three zones of increasing temperature including a preliminary zone at the input portion of the apparatus, final microwave-heated zone at the output portion of the apparatus, and a central heating zone at the intermediate portion of the apparatus. The preliminary heating zone and the central heating zone are heated by resistance type heater means, but the final heating zone which is capable of achieving temperatures as high as 3500° F is microwave heated. Since the temperature progressively increases in each successive zone, and since the particulate materials tend to shrink in bulk as they proceed through the successive zones, the insulation in the cover and in the pan is made thicker and thicker, and the trough and air space above it therefore become smaller and smaller, whereby the trough in the vicinity of the microwave heated zone gathers the material being treated into a volume of small cross-section. Means is provided to make the microwave zone resonate and to provide a high-Q termination for the waveguide which impinges the microwave energy onto the materials in the trough. The vibrating conveyor continuously tosses and mixes these materials so that they are uniformly exposed to heating in the various zones.

It is the principal object of this invention to provide heat-treating apparatus including high-Q microwave heating, in combination with continuous flow through the apparatus of the material being treated, in combination with minimization of thermal loss from the apparatus whereby a very high temperature of the material is achieved in the final heating zone.

It is another major object of the invention to provide apparatus operating with high efficiency so that materials having a relatively low dielectric loss characteristic can be efficiently raised to a high temperature.

Another object of the invention is to provide effective microwave choke sealing, which is necessary in a high-Q system, while at the same time accommodating the motion of the vibrating conveyor pan relative to the stationary cover.

A further object of the invention is to provide a bulk material heat-treating apparatus capable of reaching high temperatures in the materials using electricity as the source of power rather than oil to fuel this sort of process.

It is a further object of the invention to provide microwave reflective means embedded in the insulation within the pan and the cover in the microwave heating zone which reflective means confine the microwaves in the final heating stage and concentrate them in the vincinity of the trough carrying the materials being treated, and said embedded reflective means providing a high-Q termination zone for the microwaves.

Another object is to provide apparatus of the type described in which the cover is easily removable from the apparatus without disturbing the conveyor pan or the liquid microwave choke groove around the pan.

Other objects and advantages of the invention will become apparent during the following discussion of the drawings, wherein:

THE DRAWINGS

Figure 1:
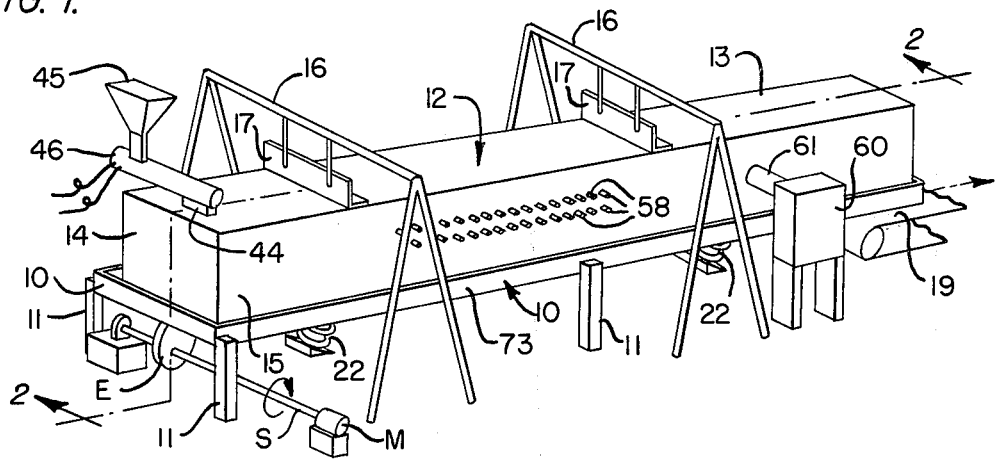
FIG. 1 is a perspective view of an apparatus according to the present invention.
Figure 2:
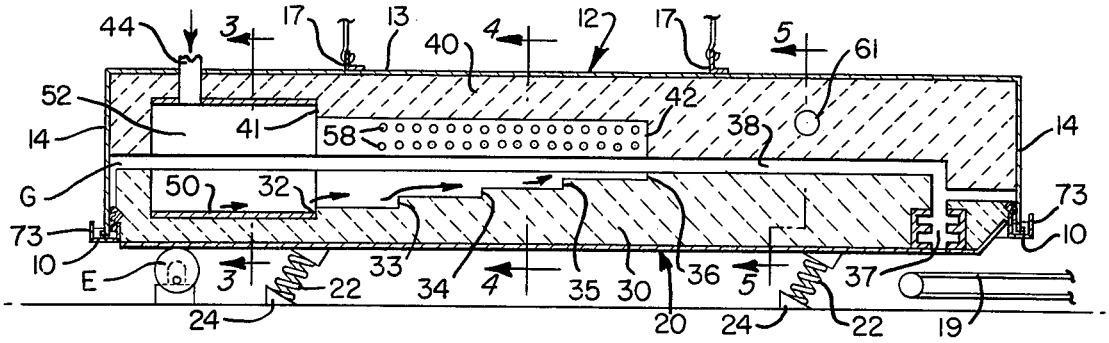
FIG. 2 is a longitudinal sectional view of the apparatus taken along line 2—2 of FIG. 1.

Referring now to the drawings, and particularly to the perspective view shown in FIG. 1 and the cross-sectional view shown in FIG. 2, the apparatus comprises a frame 10 which is supported on legs 11 which sit on the floor. The frame is an open frame as can be seen in FIG. 2 having a groove which extends all the way around it forming a microwave choke, to be discussed hereinafter, and the frame receives a cover 12 having a top surface 13, end surfaces 14, and side surfaces 15. The lower peripheries of the end surfaces 14 and the side surfaces 15 of the cover lie in the microwave choke groove around the periphery of the frame 10 and are bolted thereto as will be discussed hereinafter with references to FIGS. 3, 4, and 5. The cover is also supported from above by A-frame members 16 having cables which extend downwardly and are connected to support angle irons 17 which are welded to the top surface 13 of the cover 12. Thus, the cover is well supported from above by the A-frames, and from below by the main frame 10 and the floor-engaging legs 11.

Within the main frame 10 there is located a metal pan 20 which sits in the main frame but does not touch it. The pan 20 is supported below, and independently of the frame 10 on a series of springs 22 which are in turn supported on blocks 24 which sit on the floor. The pan is therefore free to vibrate. It will be noted that the springs are disposed at a 45° angle with respect to the floor, and that the frame is vibrated in an undulating path by a drive mechanism comprising a motor M driving a shaft S which in turn drives an eccentric E which is coupled to move the pan both vertically and horizontally. This suspension and drive mechanism is not part of the applicant's invention when considered out of combination with the other elements of the invention because it is a purchased item manufactured and sold as a vibrating conveyor suspension. The motion of the pan 20 as a result of the drive by the motor M and the eccentric E is an elongated motion having vertical and horizontal components, but these components of motion being disposd to provide a resultant motion angled rightwardly at 45°, whereby particular material within the pan 20 are caused to progress in a rightward direction and are subjected to a tossing motion within the pan which causes the particles to be mixed and distributed so as to expose all of the contents of the pan to heat impinging upon them from above in a manner to be hereinafter described.

Within the pan, there is a refractory insulation 30 which amounts to a relatively thin coating in the pan at the left end thereof, but which closes in from the sides toward the center of the pan and becomes progressively thicker in the bottom of the pan from left to right as shown in FIG. 2. The insulation steps to a greater thickness at the locations marked 32, 33, 34, 35, and 36 and to the right of the step 36 remains approximately the same thickness until the exit for the material is reached at the point marked 37.

Likewise, the cover 12 is partly filled with refractory insulation which is rather thinly coated inside the cover at the right end, steps downwardly so that the insulation thickens at the point labelled 41, and steps downwardly again so that the insulation further thickens at the point marked 42. The insulation used for the linings 30 and 40 is a castable material which can be foamed so as to leave bubbles in it. The material is fully transparent to microwave energy, but has extremely poor thermal conductivity.

At the left end of the cover 12, there is a particulate materials inlet 44 which is supplied with particulate material to be treated which is taken from a hopper 45 and delivered to the inlet 44 by a screw conveyor 46 which may be powered by an electric motor (not shown). The screw conveyor 46 is designed to comprise a microwave choke, this being accomplished by having the clearances in the conveyor and the space between convolutions of its screw smaller than a one-quarter wavelength or equal to odd multiple of a quarter wavelength of the microwave frequency being used, this dimensioning providing effective choking of any microwave energy seeking to escape from within the apparatus through the screw conveyor.

At the outlet for the treated particulate material, the exit 37 through the pan 20 is dimensioned to provide a cylindrical choke 37, whereby microwaves are prevented from leaving through the exit. The treated particulate material leaves through the choke 37 and, in the illustrated embodiment, falls onto a conveyor 19 which carries it away.

Figure 3:
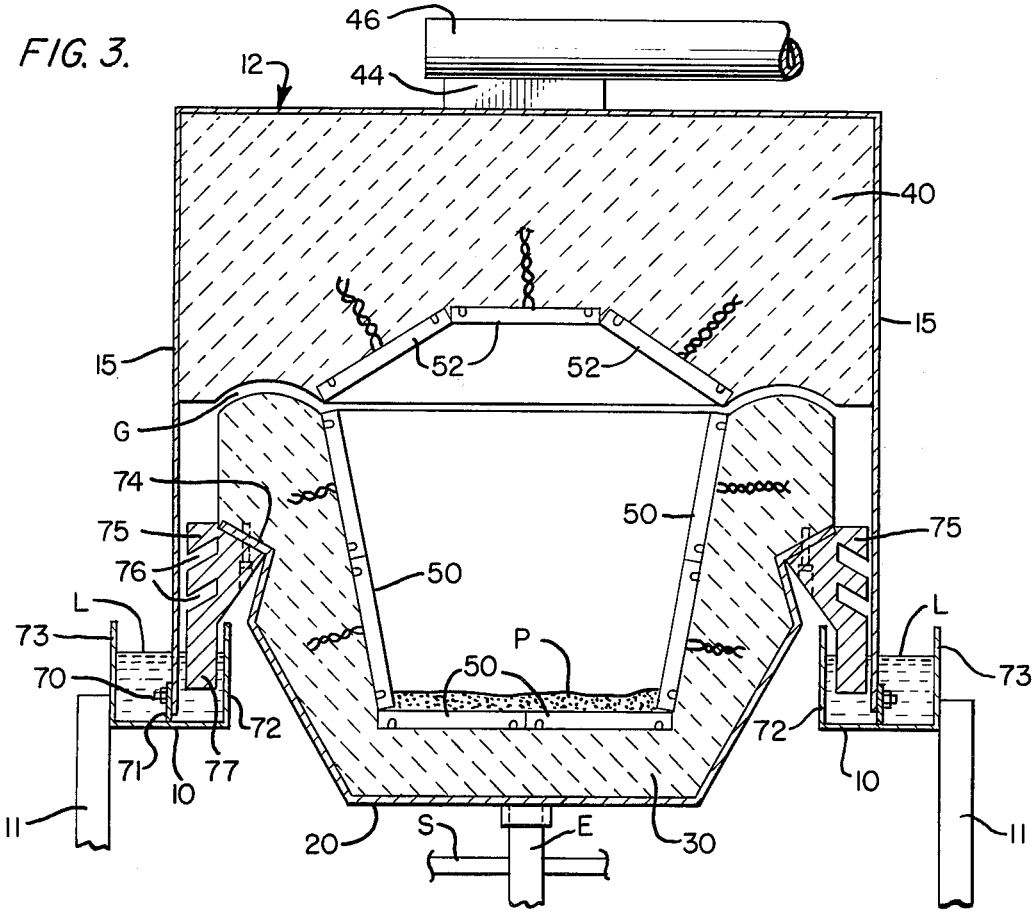
FIG. 3 is an enlarged transverse sectional view of the apparatus taken along line 3—3 of FIG. 2.
Figure 4:
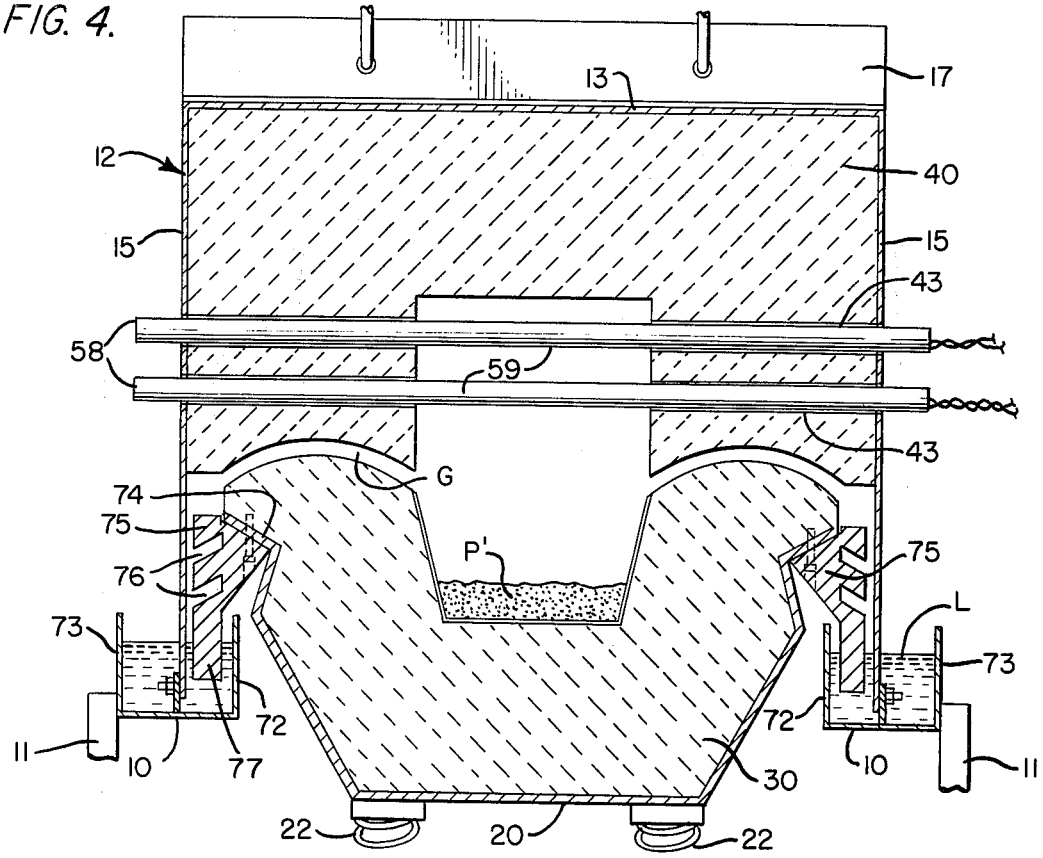
FIG. 4 is an enlarged transverse sectional view of the apparatus taken along line 4—4 of FIG. 2.
Figure 5:
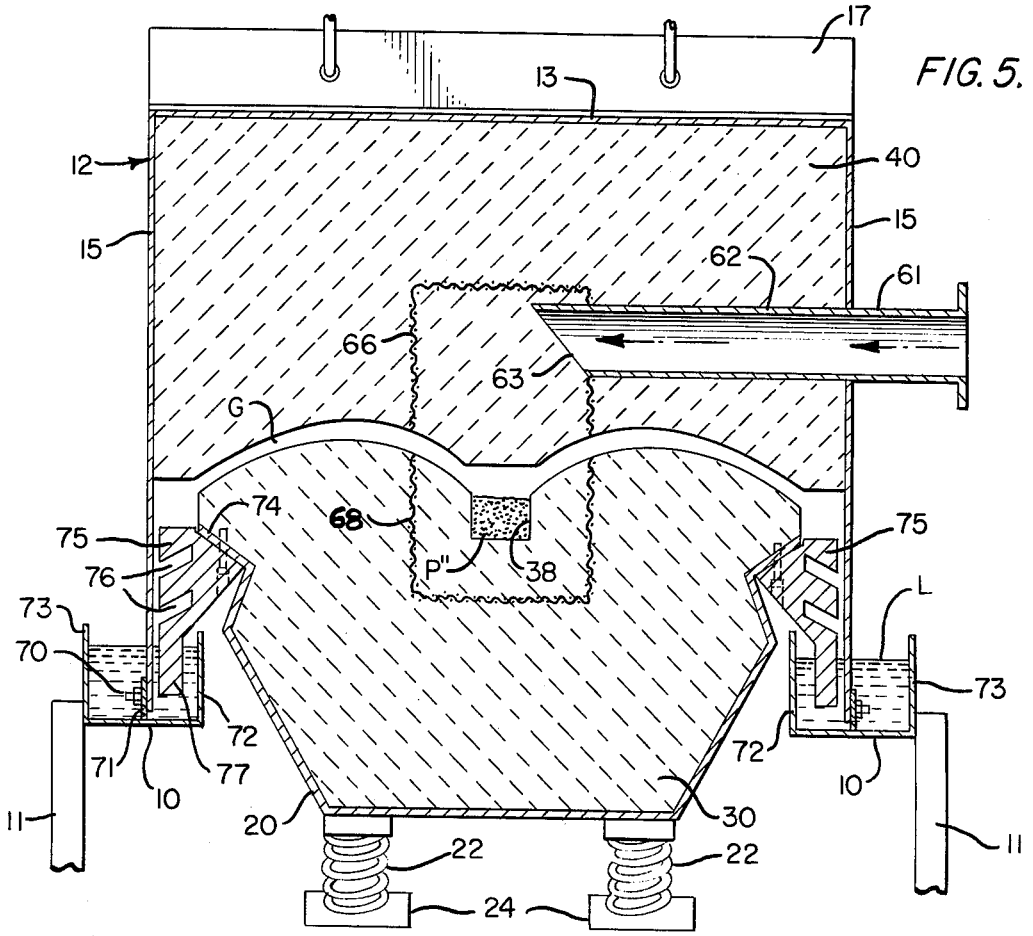
FIG. 5 is an enlarged transverse sectional view of the apparatus taken along line 5—5 of FIG. 2.

The shape of the trough through which the granular materials travel can best be seen in FIGS. 3, 4, and 5 which are cross-sections taken transversely through the sectional view, FIG. 2, at the locations indicated thereon. At the left-hand input end of the apparatus, the trough is large and deep, and it is lined with electric heat plates labelled 50 in the trough and 52 in the cover above the trough. These heat plates are provided with appropriate wiring which is lead outwardly through the insulation and connected to a power source, not shown, located outside of the apparatus. This cross-section as illustrated in FIG. 3 amounts to the first zone which is the preheating zone occupying the input portion of the apparatus. In this zone the particulate material which is dropped into the trough through the inlet 44 and is labelled P in FIG. 3 is subjected to preheating which raises its temperature from ambient temperature at which it enters the apparatus, the material, however, progressing from the preheating zone shown in FIG. 3 up through the various steps 32, 33, 34, and 35, most of which steps comprise portions of the trough which are located in the second heating zone which is illustrated in FIG. 4. It will be noted that the particulate material P' located in the second zone as shown in FIG. 4 is confined to a smaller space, because the particulate material tends to have broken up and become smaller and more granular, and some of the material has already been converted to the gamma phase alumina which is no longer a hydrate, and which has accordingly shrunk in the volume. In this second heating zone, the heat is introduced into the particulate material P' by electrically heated silicon carbide rods 58 which have electrical heating elements in their contral portions 59 which heat them to a very high temperature. A temperature of about 2000° F can be achieved in the particulate material P' in this second zone using the rods 58 which are mounted in the cover and extend through the side surfaces 15 thereof through openings which are deliberately sized so as to serve as chokes preventing the microwave energy from escaping therethrough. The rods extend through openings 43 in the insulation 40 and they are a very close fit in this insulation so as to discourage the loss of heat through the openings 43. The particulate material P' passing through the central heating zone occupied by the heating rods 58 is raised to a temperature of about 2000° F, and in the case where the input material is alumina hydrate, the particulate material P' passing out of the central heating zone at the steps 36 and 42 will have had the moisture removed therefrom, will be slightly shrunk in volume, and will be gamma phase alumina (aluminum oxide). As mentioned above, gamma phase alumina is not a satisfactory product to be shipped, because it will absorb moisture again and return to the hydrate stage. Therefore, the microwave treatment in the third and final zone as shown in FIG. 5 is required in order to change the gamma phase alumina to alpha phase alumina. The particulate alumina in the final zone 38 of the trough as shown in FIGS. 2 and 5 travel along the length of this trough, and passes through a microwave treating zone which is best seen in FIG. 5. In this zone, the material will shrink to one third its original volume. The trough is very narrow and shallow, and this narrowness and shallowness is an advantage because it permits maximum thickness of the insulation beyond the trough and out to the edges of the insulation located at the inner surfaces of the pan 20 and the cover 12.

A microwave generator 60. FIG. 1, delivers microwave energy through a wave guide 61 which passes through a snug opening 62 in the insulation 40 and terminates near the center of the apparatus and above the portion 38 of the trough. The inner end 63 of the wave guide 61 is located inside a microwave confining screen comprising an upper portion 66 and a lower portion 68. The upper portion 66 comes very close to touching the lower portion 68, although it is not actually in contact with it. However, the two screens form a virtually enclosed wave guide chamber including the inner end of the wave guide 61 and the materials which are located inside the portion 38 of the trough, and this screen 66 tends to retain and concentrate the microwaves in the vicinity of the particulate material P", while at the same time discouraging their escape to the remainder of the apparatus. In addition, the chamber enclosed by the screen 66–68 serves as a termination for the wave guide, and this termination is designed in such a way as to transfer and dissipate maximum energy within the screen chamber. Thus, a high-Q microwave heating system is achieved which is capable of heating materials, even materials having relatively low dielectric loss characteristics to a high temperature. The required temperature to change the particulate material from gamma phase to alpha phase alumina is about 3000° F. As a matter of fact, temperatures of 3,500° F have been achieved using apparatus according to the present invention.

As mentioned above in connection with FIGS. 1 and 2, the pan 20 and the insulating material 30 within it, and the particulate material P, P', and P" all vibrate with an orbital motion which causes the material to advance within the trough in the insulation 30. In the actual equipment, the amplitude of this motion is about 1 inch, and since the cover 12 and the frame 10 are stationary, clearances must be provided between these stationary members and the pan so that the vibration can be freely carried out. For this purpose, there is a gap G as shown in FIGS. 3, 4, and 5 which must always be maintained between the insulation 30 in the vibrating pan, and the insulation 40 in the stationary cover 12. It will be noticed that the gap is made arcuate rather than comprising a horizontal gap, and this arcuate shape of the gap serves the purpose of reducing the amount of heat which is lost from the system by simple radiation outwardly. The radiation losses are less through a curved path than they would be in a straight path. In addition, it is extremely important to prevent the escape of microwaves from inside the cover 12 and the pan 20 both from the point of view of conserving energy which becomes a source of heat within the apparatus and also from the point of view of safety of the personnel working with the apparatus. For this purpose, the present invention provides microwave chokes sealing all openings, not only where the particulate materials enter and depart from the apparatus, and where the electric heater elements and their wiring extend through the apparatus, but also between the vibrating pan 20 and the frame 10 and cover 12 which are stationary. As mentioned above, the frame 10 is bolted to the cover 12 using bolts 70 which pass through a flange 71 extending upwardly from the bottom groove of the frame 10. The frame 10 has upstanding inner and outer sidewalls 72 and 73 which extend all the way around the frame 10 and which confine an absorbing liquid, such as water in the groove of the frame 10.

The pan 20 is the same shape throughout its entire length, and is provided with an upward flange 74 which is secured by means of bolts through a microwave choke plate 75 which is not only spaced close to the inner surface of the cover 12, but also has choke cavities 76 located in its outer surface. The lower end 77 of the choke plate is always immersed in the liquid L contained within the groove in the frame, and for this purpose, water has been found satisfactory since it can absorb most of the microwave energy which may leak through the choke and transforms it to heat in the water.

The immersed microwave choke plates 75 and the gaps G are designed so that the pan 20 will be free to vibrate through its full amplitude without solid parts coming in contact with each other, and the construction provided in the illustrated embodiment is especially designed to confine heat within the apparatus to the greatest possible extent. The heat energy introduced into the three zones, respectively by the heater plates 50–52, by the silicon carbide resistance rods 58–59, and by the microwave energy devices 60, 61, and 66 introduce a tremendous amount of heat into the apparatus, and the height of the temperature which can be achieved by the heat which is introduced in this manner is limited only by the rate of loss of heat from the apparatus. The particulate material in passing through the apparatus fills up filets in front of each of the steps 32, 33, 34, 35, and 36 and travels upwardly by way of these filets so that it rises from the lower level 31 where it is introduced to the upper level 38 from which it is discharged by going up the steps of the trough. These steps are not necessary, and could be replaced by a continuous upward inclined surface. However, the steps tend to trap the material and make it stay in the various stepped locations for a longer interval of time so that as it is tossed and mixed at each step before departing to the next step, all of the particulate material is thoroughly heat treated and raised to the maximum temperature achieved at that particular step.

The present invention is not to be limited to the exact form shown in the drawings, for obviously changes may be made within the scope of the following claims.

We claim:

1. Electrical apparatus for heat treating particulate materials passing in bulk through the apparatus from an input end to an output end thereof, comprising:

a conveyor pan elongated in the direction of travel of the materials;

drive means operative to vibrate said pan and impart to it a motion to advance said materials in said direction of travel;

an elongated cover over said pan having side and end walls closely spaced with respect to said pan;

cover support means for supporting said cover above said pan;

refractory heat insulation lining said pan, the insulation nearly filling the pan at a portion thereof near said output end but leaving a narrow shallow material conveying trough, the insulation partially lining the pan at a portion thereof near said input end but leaving a wider and deeper trough, and the depth and width of the insulation gradually increasing from the input end to the output end so that the trough becomes progressively narrower and shallower as it passes through the portion of the pan intermediate the input and the output portion;

refractory heat insulation in the cover graduated to increase in thickness and width from the input end to said output end so that the insulation in the cover converges on the trough to form therewith an air space which becomes progressively smaller;

electric heater means in the air space located in said input and intermediate portions and directed to heat materials in the trough;

a microwave generator; and waveguide means coupled to the generator and extending through the insulation and directed to impinge microwave onto materials in the portion of the trough near said output end.

2. Apparatus as claimed in claim 1, wherein said pan and said cover are made of metal, the cover having a materials inlet at the input end extending down through its insulation, and the pan having a materials outlet at its output and extending down through its insulation from said trough; and microwave choke means sealing the space between the side and end walls of the cover and the pan.

3. Apparatus as claimed in claim 2, wherein the microwave choke comprises a metal groove around the pan opening upwardly and having microwave choke plates spaced to cooperate with the walls of the cover, and the groove being filled with water to a level above the lower periphery of the cover walls.

4. Apparatus as claimed in claim 2, further comprising input conveyor means coupled with said materials inlet in the cover, the input conveyor means comprising metallic members shaped to choke microwaves and prevent their escape from the materials inlet.

5. Apparatus as claimed in claim 1, wherein the pan and the cover are disposed horizontally, and the trough rises upwardly in the pan from a lower input portion to a relatively higher output portion, said rise occurring through a series of upward steps in said intermediate portion.

6. Apparatus as claimed in claim 1, wherein the cover insulation surfaces and pan insulation surfaces which are located transversely outside of the air space of the trough approach each other in close non-contacting proximity and comprise arcuate adjacent surfaces whose curvature reduces the escape of heat therebetween by radiation.

7. Apparatus as claimed in claim 1, wherein said electrical heater means comprises multiple electrical heating rods extending through the air space between and below the cover insulation and disposed to radiate heat into the intermediate portion of the trough.

8. Apparatus as set forth in claim 7, wherein said electric heater means comprises resistance heated plates lining the insulation around the groove and the air space in the cover insulation above the groove and located in the input portion of the apparatus.

9. Apparatus as claimed in claim 1, wherein said waveguide means extends through the cover and the insulation in the cover and terminates above the trough near the output end thereof, and microwave reflecting means embedded in the insulation about the trough and disposed to reflect microwaves travelling away from the trough back into the trough.

10. Apparatus as claimed in claim 9, wherein said microwave reflecting means has opposed parts embedded with one part in the pan insulation and the other part in the cover insulation and with the peripheries of the two parts closely approaching each other, and the waveguide extending into said other part and terminating within the insulation located in said other part.

11. Apparatus as claimed in claim 9, wherein said microwave reflecting means comprises a microwave-confining high-Q termination coupled with the waveguide inside the cover, and the trough extending therethrough with said intermediate portion on one side and a materials outlet on the other side thereof.

12. Apparatus as claimed in claim 11, wherein the materials outlet is provided with microwave choke means to prevent the escape of microwaves therethrough.

* * * * *